United States Patent [19]

Kawamura et al.

[11] 4,345,564

[45] Aug. 24, 1982

[54] FUEL INJECTION VALVE DRIVE SYSTEM

[75] Inventors: Yoshihisa Kawamura, Fujisawa; Kesao Matsuto; Masaaki Saito, both of Yokosuka, all of Japan

[73] Assignee: Nissan Motor Company, Limited, Yokohama, Japan

[21] Appl. No.: 107,832

[22] Filed: Dec. 28, 1979

[30] Foreign Application Priority Data

Aug. 1, 1979 [JP] Japan ..... 54-1188

[51] Int. Cl.[3] ..... F02D 5/02; H01F 7/18

[52] U.S. Cl. ..... 123/490; 361/154

[58] Field of Search ..... 123/490; 361/154, 196

[56] References Cited

U.S. PATENT DOCUMENTS

| | | | |
|---|---|---|---|
| 2,970,246 | 1/1961 | Gunkel | 123/490 |
| 3,700,985 | 10/1972 | Applequist | 361/154 |
| 3,852,646 | 12/1974 | Mason | 361/154 |
| 3,913,536 | 10/1975 | Läpple et al. | 123/490 |
| 3,982,505 | 9/1976 | Rivere | 123/490 |
| 4,234,903 | 11/1980 | Harper | 123/490 |
| 4,238,813 | 12/1980 | Carp et al. | 123/490 |

*Primary Examiner*—Charles J. Myhre
*Assistant Examiner*—Andrew M. Dolinar
*Attorney, Agent, or Firm*—Schwartz, Jeffery, Schwaab, Mack, Blumenthal & Koch

[57] ABSTRACT

A fuel injection valve drive system is disclosed for use in an internal combustion engine including at least one solenoid operated fuel injection valve. The system comprises a first pulse generator for providing, in synchronism with rotation of the engine, a first pulse signal having a constant pulse width, a second pulse generator for providing a second pulse signal of pulse width dependent upon the amount of air introduced to the engine, first switch means responsive to a first pulse signal for allowing small current to flow through the solenoid coil of the fuel injection valve so as not to open the fuel injection valve, and second switch means responsive to a second pulse signal for allowing large current to flow through the solenoid coil so as to open the fuel injection valve. Means are provided for causing the second pulse generator to generate a second pulse signal a time after the first pulse generator generates a first pulse signal.

9 Claims, 5 Drawing Figures

FUEL INJECTION VALVE DRIVE SYSTEM

BACKGROUND OF THE INVENTION

1. Field of the Invention

This invention relates to improvements in a fuel injection valve drive system for use in an internal combustion engine having at least one solenoid operated fuel injection valve.

2. Description of the Prior Art

Fuel injection valve drive systems have been used in spark ignition type internal combustion engines having a plurality of fuel injection valves disposed at the intake ports of the respective cylinders or a single fuel injection valve disposed at the entrance of the intake manifold. Such a fuel injection valve drive system is adapted to provide, in synchronism with rotation of the engine, a drive pulse signal having a pulse width corresponding to the amount of air introduced to the engine, to operate the fuel injection valve(s). The fuel injection valve(s) is opened each time a pulse is applied thereto and remains open throughout the duration of the pulse to discharge a controlled amount of fuel therethrough so as to provide a predetermined air-fuel ratio. Particularly in single point fuel injection systems where a single fuel injection valve is provided at the entrance of the intake manifold, the fuel injection valve usually has a relatively large opening size to allow injection of fuel in amounts required for all of the cylinders over the broad fuel range from idling to high load conditions. Further, the period of opening of the fuel injection valve varies over the broad range of fuel demand and can be as short as about 2 msec or less during idling. Since single point injection valves utilize a winding of large impedance, it is very difficult to control the fuel injection valve without undue fluctuations in the amount of fuel injected though the fuel injection valve. As a result engine operation and increased undesirable exhaust emissions are experienced when a small amount of fuel is required, such as during idling.

SUMMARY OF THE INVENTION it is therefore one object of the present invention to provide an improved fuel injection valve drive system for use in an internal combustion engine which can operate at least one fuel injection valve with improved response and control to ensure that the amount of fuel injected through the fuel injection valve is regulated with great accuracy.

According to the present invention, this and other objects are accomplished by a fuel injection valve drive system for use in an internal combustion engine including at least one solenoid operated fuel injection valve having a solenoid coil, the drive system comprising a DC power source, a first pulse generator for providing, in synchronism with rotation of the engine, a first pulse signal having a constant pulse width, a second pulse generator for providing a second pulse signal having a pulse width dependent upon the amount of air introduced to the engine, delay means for causing the second pulse generator to generate a second pulse signal a time after the first pulse generator generates a first pulse signal, first switch means connected in series with the solenoid coil for connecting the coil to the DC power source to allow a small current to flow through the coil insufficient to operate the fuel injection valve in response to a first pulse signal, and second switch means connected in series with the solenoid coil for connecting the coil to the DC power source to allow a large current to flow through the coil sufficient to open the fuel injection valve in response to a second pulse signal.

Other objects, means and advantages of the present invention will become apparent to one skilled in the art thereof from the following description.

DESCRIPTION OF THE PREFERRED EMBODIMENTS

Figure 1:
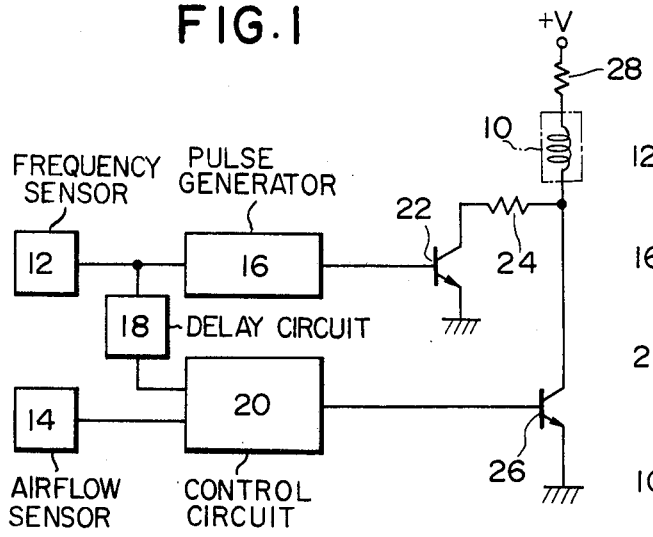
FIG. 1 is a diagram showing one embodiment of a fuel injection valve drive system made in accordance with the present invention.

Referring now to FIG. 1, there is illustrated a fuel injection valve drive system, embodying the present invention, for controlling the operation of a solenoid operated fuel injection valve of the type which has a solenoid coil, designated at 10, for opening the fuel injection valve when energized. The drive system comprises an engine rotational frequency sensor 12 such as one sensitive to ignition signals fed from the ignition distributor incorporated in the engine for detecting the frequency of rotation of the engine, and an airflow sensor 14 for sensing the amount of air introduced to the engine.

The output of the rotational frequency sensor 12 is coupled to a pulse generator 16 which generates at its output a pulse signal of constant pulse width each time it receives a trigger pulse from the speed sensor 12. The output of the speed sensor 12 is also coupled through a delay circuit 18 to a control circuit 20. The control circuit 20 has an additional input from the airflow sensor 14 for generating at its output a control pulse signal having its pulse width varying in accordance with the amount of air introduced to the engine each time it receives a trigger pulse fed thereto through the delay circuit 18 from the speed sensor 12. Due to the presence of the delay circuit 18 between the speed sensor 12 and the control circuit 20, the pulse signal appearing at the output of the control circuit 20 occurs at a time after the occurrence of the pulse signal appearing at the output of the pulse generator 16.

The output of the pulse generator 16 is coupled to the base of a first switch transistor 22 (of the NPN type in the illustrated case) which has its emitter grounded and its collector connected through a resistor 24 to the negative terminal of the solenoid coil 10. The output of the control circuit 20 is coupled to the base of a second switch transistor 26 (of the NPN type in the illustrated case) which has its emitter grounded and its collector connected to the negative terminal of the solenoid coil 10. The positive terminal of the solenoid coil 10 is connected to a voltage source through a resistor 28 which serves to restrict current flow through the solenoid coil 10 so as to protect the winding 10 from overheating for longer valve life. The first transistor 22 becomes conductive to allow a first current flow through the solenoid coil 10 of the fuel injection valve when a pulse signal from the pulse generator 16 is applied to the base of transistor 22. The resistance value of the resistor 24 is selected so that a small amount of current flows through the solenoid coil 10 which is insufficient to open the fuel injection valve. When a pulse signal from the control circuit 20 is applied to the base of the 2nd transistor 26, the second transistor 26 becomes conductive, and a second current flows through the solenoid coil 10 to cause the fuel injection valve to open.

Figure 2:
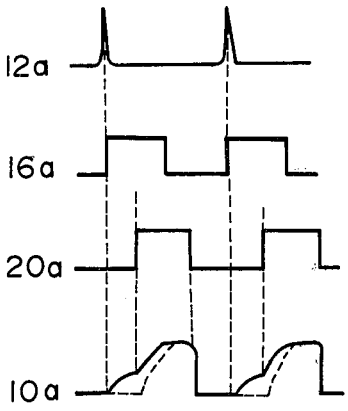
FIG. 2 illustrates voltage waveforms showing the various voltages and their timed relationship developed by the system of FIG. 1.

In operation, each time a trigger pulse, as shown in the waveform 12*a* of FIG. 2, is applied to the input of the pulse generator 16, it provides a positive rectangular pulse of constant pulse width, as seen in the waveform 16*a* of FIG. 2, to the base of the first transistor 22 which becomes thereby conductive throughout the duration of the latter to allow a small current to flow through the solenoid coil 10. At this time, the fuel injection valve is still held closed due to th provision of the resistor 24. Each time the delayed trigger pulse is applied to the input of the control circuit 20, it provides a positive rectangular pulse having a pulse width dependent upon the amount of air introduced to the engine as seen in waveform 20*a* of FIG. 2. The output pulse from control circuit 20 is applied to the base of the second transistor 26 which becomes thereby conductive throughout the duration of the pulse to allow an increased amount of current to flow through the solenoid coil 10, causing the fuel injection valve to open and discharge fuel in amounts determined in accordance with the amount of air introduced to the engine so as to provide a predetermined air-fuel ratio.

That is, the second switch transistor 26 becomes conductive a time after the first switch transistor 22 becomes conductive so that the solenoid current is rapidly increased from a level insufficient to open the fuel injection valve during the time after the first switch transistor 22 becomes conductive to a level sufficient to open the fuel injection valve. It can be seen in waveform 10*a* of FIG. 2 that when the second transistor 26 becomes conductive, the actual solenoid current, indicated by the solid curve, is somewhat higher than the current, indicated by the broken curve, which will flow through the solenoid coil 10 if the first switch transistor 22 is removed. Thus, the fuel injection valve can be rapidly open with improved responsiveness to the application of the pulse signal from the control circuit 20 to the base of the second switch transistor 26.

Figure 3:
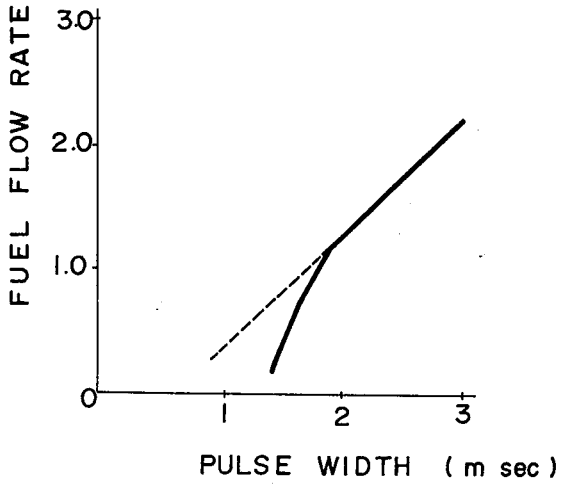
FIG. 3 is a graph showing the comparative operation of the fuel injection valve of the present invention and a conventional one.

With the fuel injection valve drive system of the present invention, the amount of fuel discharged through the fuel injection valve varies in proportion to the pulse width of control pulse signals substantially over the fuel range of operation of the fuel injection valve as shown by the broken line in FIG. 3 wherein the solid curve indicates discharged fuel flow characteristics provided by conventional systems. This permits control of the amount of fuel discharged through the fuel injection valve with higher accuracy.

Figure 4:
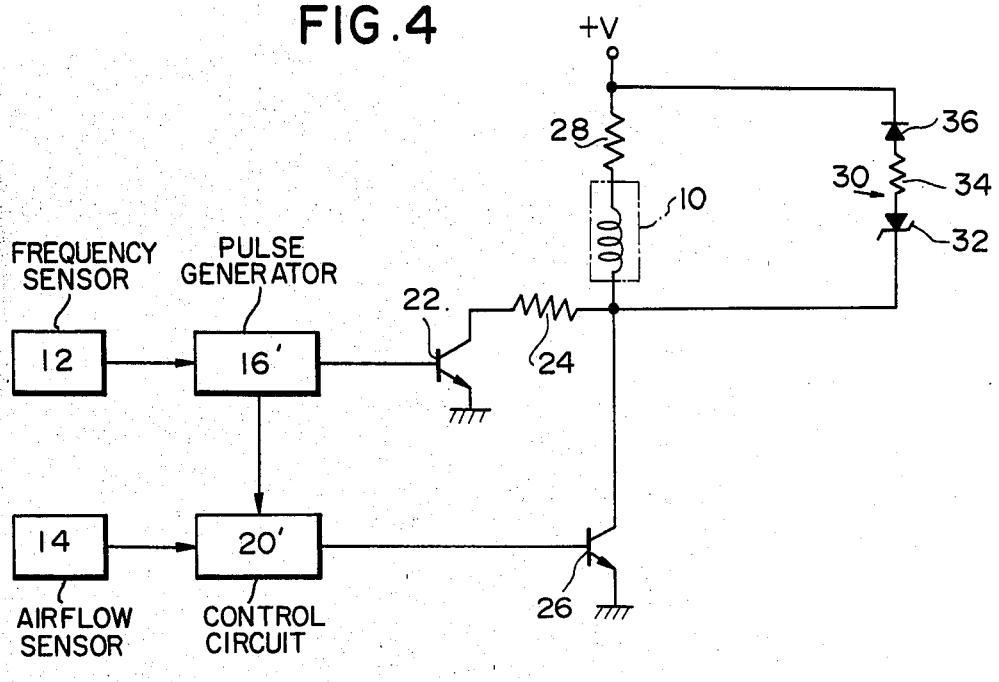
FIG. 4 is a diagram showing an alternative embodiment of the present invention.

Referring to FIG. 4, there is illustrated a second embodiment of the present invention. Parts in FIG. 4 which are similar to those in FIG. 1 have been given the same reference character. Parts which are slightly different in function have been given the same reference character with a prime suffix.

Figure 5:
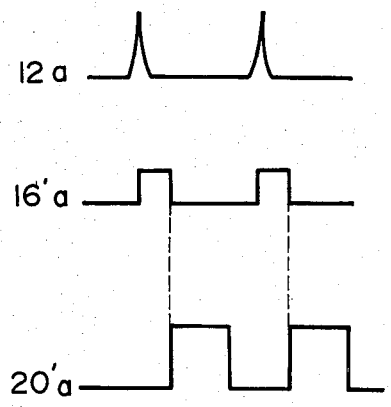
FIG. 5 illustrates voltage waveforms showing the various voltages and their timed relationship developed by the system of FIG. 4.

In this embodiment, the trigger pulse signal, as seen in waveform 12*a* FIG. 5, developed at the output of the rotational frequency sensor 12, is coupled to a pulse generator 16' which generates, at its output, a pulse signal of constant pulse width corresponding to the delay time provided by the delay circuit 10 of FIG. 1, as seen in waveform 16'*a* of FIG. 5 each time it receives a trigger pulse from the rotational frequency sensor 12. The output of the pulse generator 16' is coupled to the base of the first switch transistor 22 and also to a control circuit 20' which has an additional input from the airflow sensor 14. The control circuit 20' generates at its output a control pulse signal, as seen in waveform 20'*a* of FIG. 5, having a pulse width dependent upon the amount of air introduced to the engine each time the pulse signal 16'*a* falls to its low level. The output of the control circuit 20' is coupled to the base of the second switch transistor 26. Thus, when the second switch transistor 26 becomes conductive a time after the first switch transistor 22 becomes conductive, the solenoid current is rapidly increased from a level insufficient to open the fuel injection valve during the time after the first switch transistor 22 becomes conductive, to a level sufficient to open the fuel injection valve.

In the second embodiment, a solenoid protection circuit 30 is provided for protecting the solenoid coil 10 from failure when the second switch transistor 26 is turned off resulting in a large counter electromotive force in the solenoid coil 10. The protection circuit 30 comprises a Zener diode 32 having its cathode connected to the negative terminal of the solenoid coil 10 and its anode connected through a resistor 34 to the anode of a diode 36 having its cathode connected through the resistor 28 to the positive terminal of the solenoid coil 10 for absorbing the counter electromotive force when it reaches the breakdown level of the Zener diode 32.

There has been provided, in accordance with the present invention, an improved fuel injection valve drive system which permits a fuel injection valve to open with quick response so as to provide improved accuracy in control of the amount of fuel injected therethrough, which results in smooth engine operation and highly desirable exhaust emission performance. While the present invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A fuel injection valve drive system for use in an internal combustion engine provided with at least one fuel injection valve operated by a solenoid coil having positive and negative terminals, the positive terminal of said solenoid coil being coupled to a power source, said drive system comprising:

(a) a reference pulse generator for generating a train of reference pulses in synchronism with the rotation of said engine;

(b) a first drive signal generator responsive to each reference pulse from said reference pulse generator for generating a first drive signal having a constant pulse width;

(c) a second drive signal generator for generating a second drive signal having a pulse width dependent upon at least one engine operating parameter, the second drive signal occurring a predetermined time period after the beginning of the first drive signal from said first drive signal generator;

(d) first switching means connected in series with said solenoid coil, said first switching means responsive to the first drive signal from said first drive signal generator for permitting a first current to flow through said solenoid coil for a time period corresponding to the pulse width of the first drive signal, the first current being insufficient to open said fuel injection valve; and (e) second switching means connected in parallel with said first switching means, said second switching means responsive to the second drive signal from said second drive signal generator for permitting a second current to flow through said solenoid coil a predetermined time period after the first current and for a time period corresponding to the pulse width of the second drive signal, the second current being sufficient to open said fuel injection valve.

2. A fuel injection valve drive system according to claim 1, wherein said second drive signal generator comprises a circuit, responsive to the application of a reference pulse from said reference pulse generator, for generating a second drive signal having a pulse width dependent upon the amount of air introduced to the engine; means for applying the second drive signal to said second switch means; and means for delaying application of the reference pulse to said circuit with respect to application of the reference pulse to said first drive signal generator.

3. A fuel injection valve drive system according to claim 1, wherein said first switching means comprises a resistor, and a switching transistor, responsive to the first drive signal, for connecting the negative terminal of said solenoid coil to ground through said resistor.

4. A fuel injection valve drive system according to claim 3, wherein said switching transistor is of the NPN-type having a base, a collector and an emitter, said base being coupled to receive the output of said first drive signal generator, said collector being coupled through said resistor to the negative terminal of said solenoid coil, and said emitter being grounded.

5. A fuel injection valve drive system according to claim 1, wherein said second switching means comprises a switching transistor, responsive to the second drive signal, for connecting the negative terminal of said solenoid coil to ground.

6. A fuel injection valve drive system according to claim 5, wherein said switching transistor is of the NPN-type having a base, a collector and an emitter, said base being coupled to receive the output of said second drive signal generator, said collector being coupled to the negative terminal of said solenoid coil, and said emitter being grounded.

7. A fuel injection valve drive system according to claim 1, which further comprises means for protecting said solenoid coil from failure when said second switching means is turned off.

8. A fuel injection valve drive system according to claim 7, wherein said protection means comprises a Zener diode having a cathode and an anode, the Zener diode cathode being connected to the negative terminal of said solenoid coil and the Zener diode anode being connected through a resistor to a diode having an anode and a cathode, the cathode being connected to the positive terminal of said solenoid coil and the anode being connected to said resistor.

9. A fuel injection valve drive system according to claim 1, wherein said second drive signal generator generates the second drive signal having a pulse width dependent upon at least one engine operating parameter in response to a falling edge of the first drive signal from said first drive signal generator.

* * * * *